US010264941B2

(12) United States Patent
Koval et al.

(10) Patent No.: US 10,264,941 B2
(45) Date of Patent: Apr. 23, 2019

(54) APPARATUS AND METHOD FOR PREPARING A SURFACE

(71) Applicants: Daniel P. Koval, Housatonic, MA (US); Richard J. Stephens, West Sussex (GB); Tom W. Jarvis, London (GB); Marc Miraldi Besa, Barcelona (ES)

(72) Inventors: Daniel P. Koval, Housatonic, MA (US); Richard J. Stephens, West Sussex (GB); Tom W. Jarvis, London (GB); Marc Miraldi Besa, Barcelona (ES)

(73) Assignee: WORKSAFE TECHNOLOGY INC., Wilmington, DE (US)

( * ) Notice: Subject to any disclaimer, the term of this patent is extended or adjusted under 35 U.S.C. 154(b) by 561 days.

(21) Appl. No.: 14/810,841

(22) Filed: Jul. 28, 2015

(65) Prior Publication Data

US 2016/0198923 A1 Jul. 14, 2016

Related U.S. Application Data

(63) Continuation-in-part of application No. 14/596,325, filed on Jan. 14, 2015, now abandoned.

(51) Int. Cl.
*A46B 15/00* (2006.01)
*A47L 13/24* (2006.01)
(Continued)

(52) U.S. Cl.
CPC ..... *A47L 13/254* (2013.01); *A46B 15/0087* (2013.01); *A46B 15/0095* (2013.01);
(Continued)

(58) Field of Classification Search
CPC ..... A46B 5/0087; A46B 15/0095; A46B 15/0097; B25G 3/38
See application file for complete search history.

(56) References Cited

U.S. PATENT DOCUMENTS 366,790 A * 7/1887 Orther ..... F16C 11/0633 15/144.2
2,764,774 A * 10/1956 Belsky ..... A47L 13/257 15/144.2
(Continued)

FOREIGN PATENT DOCUMENTS

CN 2245425 1/1997
CN 202408764 U 9/2012
(Continued)

OTHER PUBLICATIONS

Japanese Office Action dated May 31, 2017 Reference No. PF12433.
(Continued)

*Primary Examiner* — Randall Chin
(74) *Attorney, Agent, or Firm* — Grogan, Tuccillo & Vanderleeden LLP

(57) ABSTRACT

Embodiments of the invention provide an apparatus for preparing a surface that includes an elongated handle and a head portion removably securable to the elongated handle via a pivot joint, the head portion being adapted to receive a surface preparation material and being capable of pivotal movement relative to the elongated handle. The apparatus is configured to allow the elongated handle to remain substantially perpendicular to the head portion without any external support.

13 Claims, 5 Drawing Sheets

(51) Int. Cl.

| | |
|---|---|
| ***B25G 3/38*** | (2006.01) |
| ***A47L 13/254*** | (2006.01) |
| ***B25G 1/10*** | (2006.01) |
| ***A47L 13/256*** | (2006.01) |
| ***A47L 13/46*** | (2006.01) |
| ***B25G 1/06*** | (2006.01) |

(52) U.S. Cl.
CPC ..... *A46B 15/0097* (2013.01); *A47L 13/24* (2013.01); *A47L 13/256* (2013.01); *A47L 13/46* (2013.01); *B25G 1/06* (2013.01); *B25G 1/102* (2013.01); *B25G 3/38* (2013.01); *Y10T 29/49826* (2015.01)

(56) References Cited

U.S. PATENT DOCUMENTS

| | | | | | |
|---|---|---|---|---|---|
| 4,475,262 | A * | 10/1984 | Downer | A46B 7/06 | 15/144.2 |
| 4,524,484 | A * | 6/1985 | Graham | A45B 9/00 | 15/144.4 |
| 5,410,771 | A | 5/1995 | Bereza | | |
| 5,551,115 | A | 9/1996 | Newville | | |
| 7,690,070 | B2 * | 4/2010 | Jung | A46B 5/0054 | 15/144.1 |
| 2003/0009839 | A1 * | 1/2003 | Streutker | A47L 13/24 | 15/228 |
| 2004/0117935 | A1 | 6/2004 | Cavalheiro | | |
| 2005/0283933 | A1 * | 12/2005 | Mitchell | B25G 1/06 | 15/144.1 |

FOREIGN PATENT DOCUMENTS

| | | | |
|---|---|---|---|
| CN | 102961094 | A | 3/2013 |
| JP | H01160961 | U | 11/1989 |
| JP | H0956653 | A | 3/1997 |
| JP | 3143618 | B1 | 3/2001 |
| JP | 2001070224 | A | 3/2001 |
| JP | 2001137168 | A | 5/2001 |

OTHER PUBLICATIONS

Korean Office Action dated Nov. 17, 2017 Application No. 10-2016-7019962.
Supplementary European Search Report and Search Opinion from the European Patent Office in connection with the European Patent Application No. 15739847.0 dated Sep. 28, 2017.
Chinese Office Action dated Oct. 9, 2016.

* cited by examiner 30
50
60
76
72
74
70
10

22
20
40
30

APPARATUS AND METHOD FOR PREPARING A SURFACE

CROSS REFERENCE TO RELATED APPLICATION

This application is a continuation in part of U.S. Ser. No. 14/596,325, filed on Jan. 14, 2015, now abandoned, which, in turn, claims the benefit of U.S. Provisional Application No. 61/931,290, filed on Jan. 24, 2014, both of which are incorporated herein by reference in their entireties.

BACKGROUND

Technical Field

Embodiments of the invention relate generally to surface preparation. Particular embodiments relate to apparatus and methods for cleaning or otherwise treating surfaces.

Discussion of Art

Known surface preparation devices, such as mop fixtures, (i.e., "mops" as referred to in a consumer context), used for cleaning, typically include a loose double articulating joint that connects the mop head to the handle. This type of joint, however, may cause the mop head to hang down when the handle is held upright, and, as a result, mops are often unsuitable for cleaning vertical, overhead, and uneven, e.g., concave or convex, surfaces. As a result, a handheld cloth may be utilized for cleaning such surfaces. This technique, however, is often ergonomically incorrect. More specifically, use of a handheld cloth typically requires a user to exert a relatively significant force on his or her hand in order to scrub a surface, while simultaneously angling the hand back towards the user's forearm, or, alternatively, pinching the user's fingers together.

More specifically, current cleaning practices utilizing a handheld cloth require two activities: 1) holding the cloth/rag; and 2) maximizing the area of the cloth/rag to the surface being cleaned. Since the user's arm is not parallel to the surface to be cleaned, such as, for example, a mirror, the far side of a tub, a tiled wall, etc., the user's hand has to be extended often to extreme postures of 90 degrees. Postures greater than 30 degrees of wrist extension, however, create fluid pressures in the carpal tunnel that are high enough to inhibit blood flow to the nerve. These high fluid pressures, combined with the forces of pressing on and pinching the cloth, are believed to increase the risk of injury.

Additionally, cleaning with a hand and rag or sponge only requires the user to frequently bend, kneel, or stretch. These are high exertion activities and if done repetitively over time, can lead to back, knee and shoulder injuries. If a person already has these injuries, the process of cleaning where these postures need to be used, can exacerbate existing conditions and cause the users pain again. Also, where the user needs to reach a high vertical surface for cleaning, such as for dusting or cleaning bathroom tiles near the ceiling, the user often needs to either stand on a ladder or other object to reach the surface to be cleaned. This leads to the inconvenience of bringing the ladder and to a risk of falling from the ladder or other object.

As will be appreciated, this is of particular concern in commercial environments, e.g., hotels, hospitals, universities, municipalities, and the like, where personnel are required to spend significant amounts of time performing repetitive cleaning tasks such as those described above.

Moreover, known surface preparation devices are not easily adaptable for different preparation tasks and surfaces. For example, mops having a head and handle may be suitable for cleaning smooth flat surfaces such as a floor. As will be readily appreciated, the traditional mop fixture handle allows a user to be spaced away from the cleaning surface, e.g., floor, so the user's back is not compromised while cleaning, assuming the handle is of sufficient length. Such mops are not well suited, however, for cleaning tasks where it is desirable for a user to be relatively close to the surface to be cleaned.

Additionally, changing removable/disposable pads or other work surfaces from surface preparation devices for routine maintenance can be inefficient. Known mop fixtures require a specific type of cleaning or preparation material to be used with the fixture. As will be appreciated, it is desirable for a user to be able to secure a standard 12-inch or 16-inch "wipe" to a mop fixture to facilitate cleaning of a wider surface area in an ergonomically safe manner.

In view of the above, it is desirable to provide an ergonomic, adaptable, and easily maintained surface preparation device.

BRIEF DESCRIPTION

Embodiments of the invention provide an apparatus for preparing a surface that includes an elongated handle and a head portion removably securable to the elongated handle via a pivot joint, the head portion being adapted to receive a surface preparation material. The apparatus is configured to allow a user to prepare a surface by grasping the elongated handle when it is attached and to prepare a surface by grasping an ergonomic portion of the pivot joint when the elongated handle detached from the head portion.

In other embodiments, the invention provides a surface preparation apparatus that includes a head portion having a base configured to removably receive a surface preparation material and a spherical handle located on the base, the spherical handle being sized for gripping by a human hand. The spherical handle is configured to pivotally and selectively mate with an elongated handle such that a user may prepare a surface by gripping the spherical handle, or, if attached, the elongated handle.

In yet other embodiments, the invention provides a method of securing a surface preparation material to a preparation apparatus by placing a head portion of the apparatus on a first side of a sheet of surface preparation material, folding the surface preparation material over onto the head portion and inserting folded over portions of the surface preparation material into a plurality of slots formed in the head portion to removably secure the material to the preparation apparatus.

In yet other embodiments, the invention provides a method of surface preparation that includes removably securing an elongated handle to a spherical handle having a surface preparation material, preparing a first surface with the surface preparation material, and removing the elongated handle from the spherical handle. The method further includes gripping the spherical handle directly by hand and manipulating the spherical handle to prepare a second surface.

Embodiments of the invention provide an apparatus for preparing a surface that includes an elongated handle and a head portion removably securable to the elongated handle via a pivot joint, the head portion being adapted to receive a surface preparation material and being capable of pivotal movement relative to the elongated handle. The apparatus is configured to allow the elongated handle to remain substantially perpendicular to the head portion without any external support.

Embodiments also provide a surface preparation apparatus that includes a head portion having a base configured to removably receive a surface preparation material and a spherical handle located on the base, the spherical handle being sized for gripping by a human hand. The spherical handle is configured to pivotally and selectively mate with an elongated handle such that a user may prepare a surface by gripping the spherical handle, or, if attached, the elongated handle; and the apparatus is configured to allow the spherical handle to remain substantially perpendicular to the base without any external support.

Further embodiments provide an apparatus for preparing a surface that includes an elongated handle, a head portion removably securable to the elongated handle via a pivot joint, the head portion being adapted to receive a surface preparation material. The pivot joint includes a ball secured to the head portion, the ball being configured to form an ergonomic handgrip when the elongated handle is disconnected from the head portion, and a bracket attached to the elongated handle, the bracket configured to be securable to a rotatable section of the ball portion. The handle being capable of axial rotation in a first direction when secured to the ball and in a second direction that is substantially perpendicular to the first.

DRAWINGS

The present invention will be better understood from reading the following description of non-limiting embodiments, with reference to the attached drawings, wherein below:

DETAILED DESCRIPTION

Figures 1, 2:
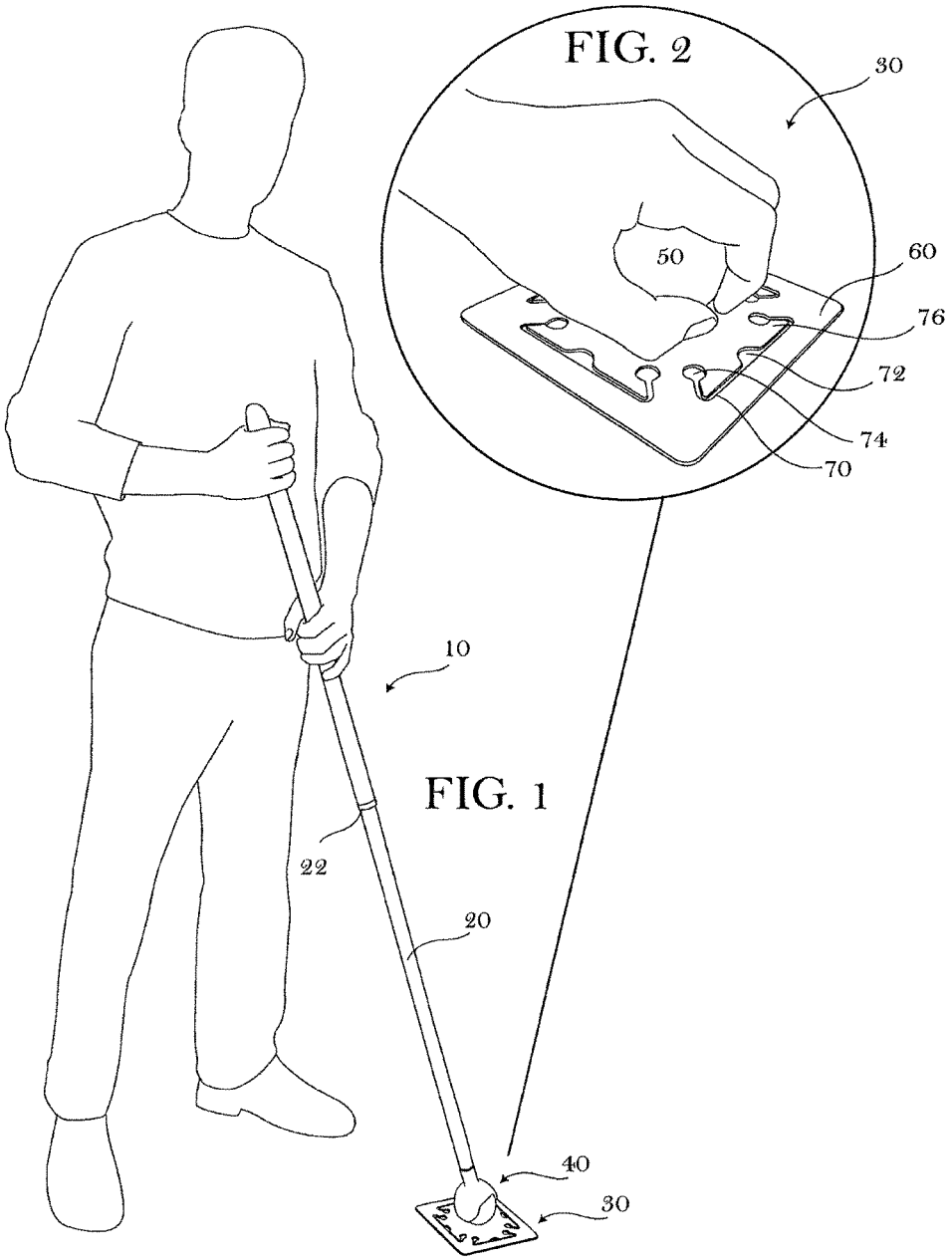
FIG. 1 is a schematic illustration of a user holding a surface preparation device according to an embodiment of the present invention.
FIG. 2 is an additional schematic illustration of a user holding a surface preparation device according to the embodiment of FIG. 1.

Reference will be made below in detail to exemplary embodiments of the invention, examples of which are illustrated in the accompanying drawings. Wherever possible, the same reference characters used throughout the drawings refer to the same or like parts, without duplicative description. Although exemplary embodiments of the present invention are described with respect to cleaning devices, such as a mop fixture, embodiments of the invention are also applicable for use with other surface preparation applications including, but not limited to, painting, sanding, polishing, and the like.

FIG. 1 illustrates a user holding an apparatus or device for surface preparation 10 according to an embodiment of the invention. As shown, the device 10 generally includes an elongated handle 20 and a head or head portion 30 located at a distal end of the handle. The handle 20 may be either fixed in length or adjustable via, for example, a telescoping joint 22. The handle 20 and head portion 30 are removably joined by an articulating joint 40, which allows the head portion 30 to pivot and rotate relative to the handle.

The head portion 30 is also configured to receive a sheet of surface preparation material 100 (FIGS. 4A-4D). As used herein, "surface preparation material" includes, but is not limited to, textiles or other materials for cleaning, nonwoven materials, rubber, e.g., a squeegee, sandpaper, dusting, polishing or buffing materials, painting materials, such as a paint brush or roller, erasers, such as a dry erase material, and the like. In certain embodiments, the material is a textile suitable for cleaning such as a cloth.

As will be appreciated, the surface preparation device 10 can be utilized to complete various cleaning tasks such as mopping, sweeping, dusting, window cleaning, wiping, or otherwise preparing a surface, and is adapted to clean or otherwise remove debris, dirt, dust, cobwebs, germs, contaminants, and the like. Such cleaning may be performed for purely aesthetics reasons; e.g., remove dust, cobwebs, etc., or to remove potential health hazards from the surface. Alternatively, the device 10 may be used to prepare a surface for bonding with another material or object; e.g., paint, wallpaper, etc. The surface preparation device 10 is, of course, not limited to the foregoing exemplary uses.

Referring now to both FIGS. 1 and 2, the removable nature of the head portion 30 from the elongated handle 20 is an important aspect of the present invention. More specifically, in certain embodiments, the device 10 can be used as a stand up implement, e.g., a mop, broom or the like, for cleaning situations where it is desirable for the user to be spaced apart from the surface to be cleaned or otherwise prepared. Importantly, however, a user may also detach the head portion 30 from the elongated handle 20 so that the head portion 30 by itself may be utilized as a surface preparation device where it is desirable for the user to be relatively close to the surface to be prepared/cleaned. As discussed in greater detail below, the head portion 30 and elongated handle are removably interconnected by a pivot joint that features an ergonomic portion, e.g., a spherical handle, that may be grasped by a user allowing the head portion 30 to be ergonomically used independent of the elongated handle.

In addition to the foregoing, the removable head portion allows a user to relatively quickly replace one head portion with another. In this manner, head portions may be quickly swapped between different tasks or different work areas thereby increasing the versatility of the device 10.

As shown in FIG. 2, the head 30 may be removably attached to the elongated handle 20 via a pivot joint 40. In certain embodiments, the pivot joint 40 may be configured as a ball and socket mechanism. As used herein, the "ball portion" or "ball" refers generally to a spherical element and the "socket" or "socket portion" refers generally to a cupped element with a partially spherical surface for slidably and rotatably engaging the ball portion. As depicted, the head 30 may include the ball portion 50 of the joint 40. The ball portion 50 may be connected to, e.g., formed integral with, or fastened to, a base 60 that is adapted for receiving a surface preparation material, such as a cloth. The handle 20 includes the socket portion 42 of the joint 40. The socket portion 42 may be connected to a distal end of the handle 20. While embodiments are described as utilizing a ball and socket joint, other pivotable joints 40 may be utilized, provided they impart a useful degree of freedom of movement, e.g., freedom of rotation, back-and-forth movement in various planes, etc.

Another important aspect is the generally spherical shape of the ball portion 50, which serves as a spherical handle. As mentioned above, the head 30 may be detached from the handle 20 and used by itself as a surface preparation device where it is desirable for the user to be relatively close to the surface to be prepared/cleaned. In this context, a user grips the head 30 by the ball portion 50. The spherical shape of the ball portion 50 is configured to fit comfortably in a user's hand and positions the user's hand and fingers for ideal pressure distribution. As a result, a user can maintain an ergonomically proper hand position versus using a cloth alone, which may help to reduce the risk of repetitive strain injury such as carpel tunnel syndrome or back injury. In this manner, the ball portion serves as a spherical handle sized for ergonomic gripping by a human hand.

Moreover, the spherical shape affords many different postures for the users, including the most important, a neutral, straight wrist posture. In particular, the spherical shape of the ball portion does not force users to hold the head 30 in any specific posture or orientation. The ball portion also allows the user to rotate or spin the head 30 and still have the same grip geometry regardless of head orientation. As a result, the spherical shape affords many different grip postures allowing the user to find the most comfortable and usable wrist postures, i.e., the ball portion has a high degree of affordance.

In addition, the size of the ball portion allows for a power grip where a user's fingers can wrap around the sphere maintaining contact. The power grip recruits larger and stronger muscle groups compared to a pinch grip, which requires smaller and weaker muscles groups to support, coordinate and stabilize the joints of the fingers. As a result acceptable force for power grip are much larger.

In certain embodiments, the ball portion has a diameter ranging from about 2 inches to about 4 inches. A particular diameter may be selected depending upon what activities the user is performing as well as the user's hand size. In one embodiment, the ball portion 30 is about 2.5 inches in diameter.

Figure 3A:
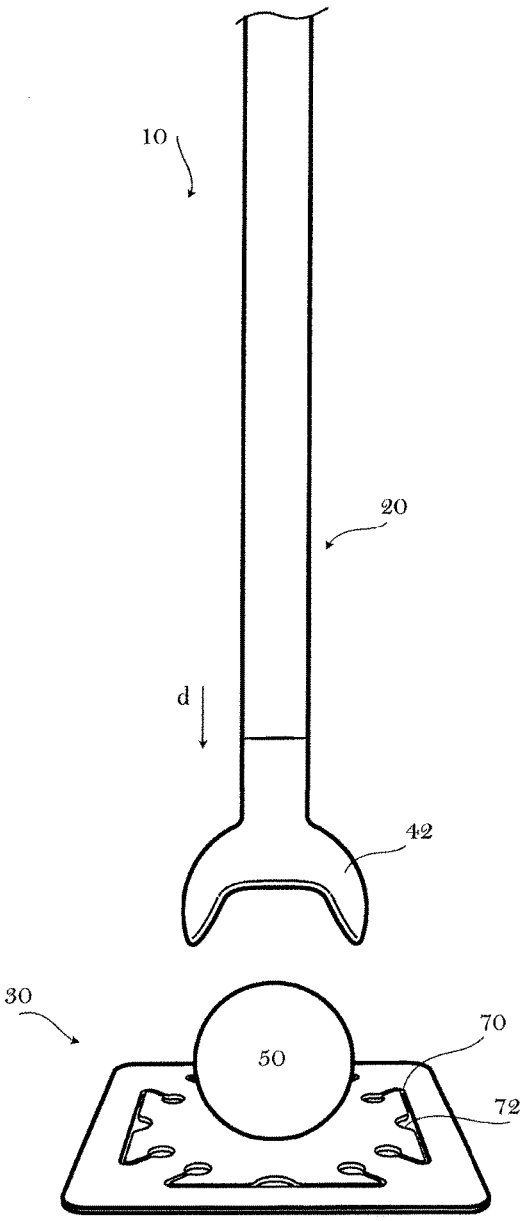
FIGS. 3A and 3B are schematic illustrations of the attachment of an elongated handle to a head portion of a surface preparation device according to the embodiment of FIG. 1.
Figure 3B:
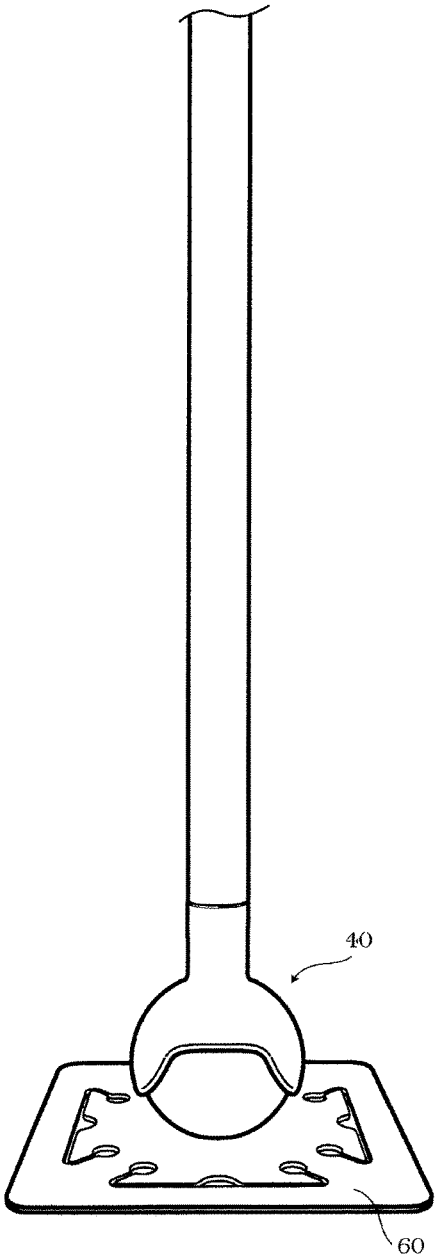
Figure 4D:
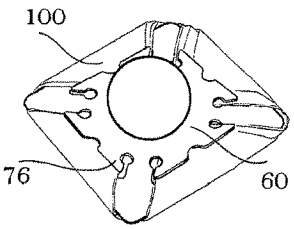
FIGS. 4A-4D are schematic illustrations depicting a method of securing a sheet of surface preparation material to a surface preparation device in accordance with embodiments of the invention.
Figure 4C:
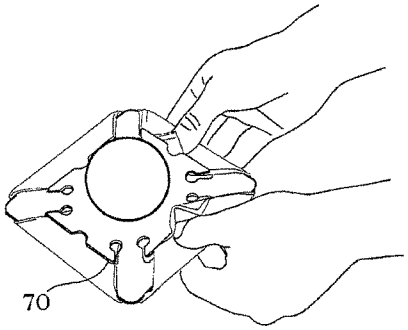
Figure 4B:
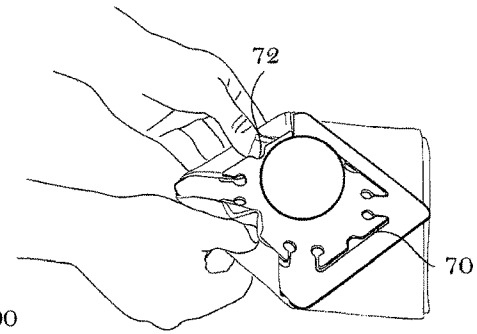
Figure 4A:
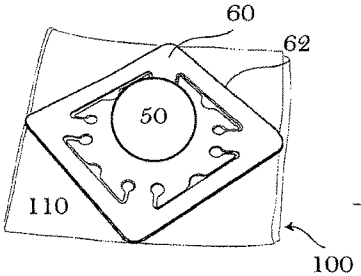

Referring now to FIGS. 3A and 3B, in use, removal of the head 30 from the handle 20 is a relatively simply process. That is, to remove or replace the head 30, the user may simply "pop" (e.g., snap) the ball 50 out of or into the socket 42 by hand. In one embodiment, a user may place the head 30 on the ground and then urge the handle downward in direction d until the socket 42 snaps over the ball 50. As will be appreciated, the ball 50 may be snug (e.g., tight) within the socket 42, which tight fit retains the ball in the socket. Indeed, the ball 50 may be secured within the socket through a press or snap fit. In certain embodiments, the ball fits tightly within the socket such that the head 30 remains movably fixed in one position with respect to the socket 42 when not in contact with a work surface. In yet other embodiments, socket 42 may resiliently maintain the head 30 in a single position, e.g., fixed in place, when the head 30 is attached to the handle.

The fit of the ball 50 within the socket 42 is another important aspect of the present invention. More specifically, the joint 40 may hold the head 30 in various positions set by a user allowing the user to easily wipe vertical and/or uneven surfaces that are typically difficult to wipe with a traditional hinged mop. For example, as described above, the head of a traditional mop tends to fall into whatever position gravity pulls it into.

The snug fit of the ball 50 and socket 42 may also reduce the need for a user to climb onto a possibly unstable object (e.g., a ladder, stool, chair, toilet, edge of a bathtub, etc.) to reach high vertical surfaces. In addition, the head 30 may be positioned horizontally to avoid kneeling on the floor to reach low areas. In this manner, the surface preparation device 10 may reduce the risk of falling as well as knee and back injuries, which are typically incurred from repeated kneeling and/or bending during traditional cleaning with a cloth in hand.

Figure 6:
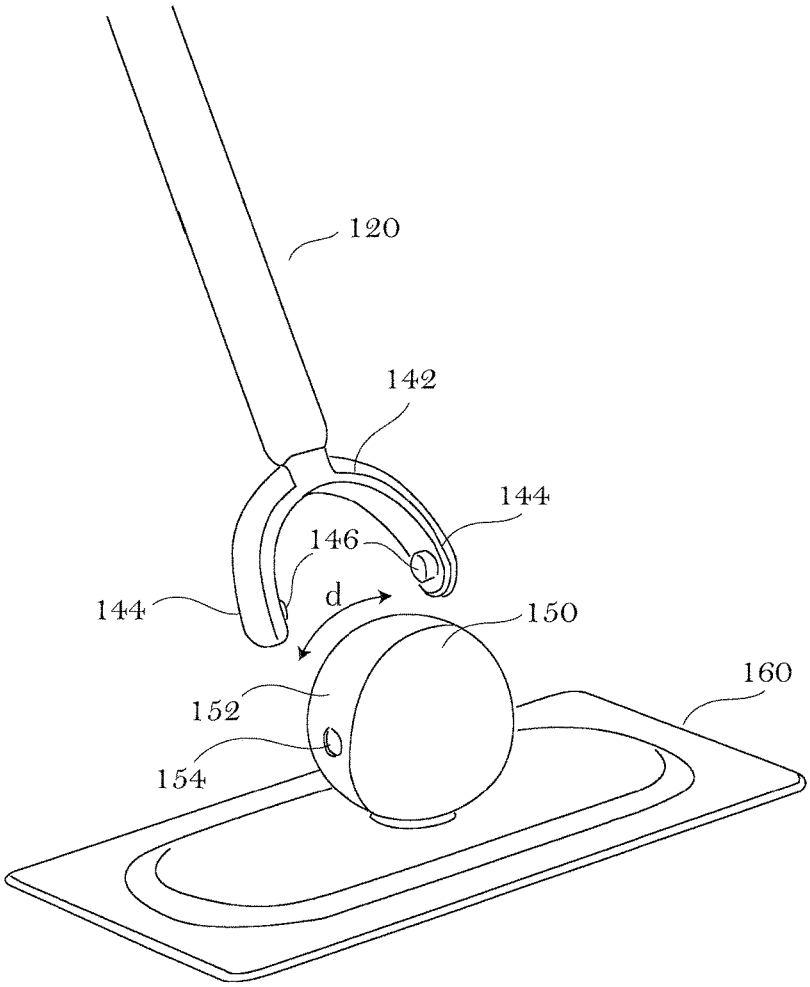
FIG. 6 is a schematic illustration of a surface preparation device according to another embodiment of the invention.

Referring to FIG. 6, in certain embodiments, the pivot joint can include a two-pronged "forked" bracket 142 and a ball portion 150 that includes a rotatable center section 152. The rotatable center section 152 can rotate axially in direction d within, for example, a channel (not shown) in the spherical surface of the ball portion 150. As shown, the rotatable center section 152 includes two annular indents or recesses 154, on opposite sides of the section 152 that are configured to receive two complementary annular protrusions 146, one on each distal end of a bracket prong 144. When attached to the rotatable center section 152, the handle 120 can rotate axially about the ball portion 150 in a first direction d. The handle may also axially rotate in a second direction perpendicular to direction d via rotation of the protrusions 146 in the recesses 154 of the ball portion 150. The protrusions 146 may be removably secured within the recesses 154 via a press or snap fit or through other means.

In certain embodiments, the ball 50 and socket 42, or other pivot joint 40 components, are configured such that they allow the handle 20 to remain in an upright position while the device 10 is not in use. More specifically, friction between the ball 50 and socket 42 allows the handle to remain in a substantially upright position relative to the head portion 30 without any external support, e.g., support by the device user, a wall, or other object. This enables a user to cease use of the device 10 by simply placing the handle 20 in an upright position, relative to the head portion 30 (i.e., the handle is substantially perpendicular to the head portion 30 or floor) and walking away from the device 10.

As will be appreciated, this "self-standing" functionality is of particular importance when a user is required to temporarily stop usage of the device 10 to perform another task or take a work break. Moreover, a user can easily resume work with the device 10 in the exact spot where work was terminated ensuring that an entire surface is treated. This may be of particular importance in a hospital, health care setting or other setting where diligent treatment of an entire surface is necessary.

In addition to the above, this functionality also enables convenient long term storage of the device 10 by ensuring that the handle 20 remains in a fixed position within the confines of a storage space such as a utility closet or the like. Indeed, treatment device handles, e.g., mop handles, currently need to either be hung from a hook during storage or placed against a fixed object such as a closet wall. In many homes and apartments hooks are not easily attached. When leaning the device against a wall for storage, the handle often slips down the wall particularly when users retrieve other devices or objects from the storage space. As will be appreciated, the associated re-placement of the device into a correct position takes time away from the owner/user and requires unnecessary exertion.

Furthermore, with the loose hinge systems of existing mop handles (or handles of other treatment devices) users must either lay the mop down onto the floor or lean the handle against a stationary object such as a wall or chair for storage. Laying the mop handle down onto the floor often results in a user placing the handle onto a dirty area or surface, thereby making the grip dirty, or laying it into a clean area, which may be wet, thus making the grip wet. Moreover, if a surface is contaminated, such as in a hospital setting, this could lead to the inadvertent spreading of harmful bacterial via the handle or the user's hands. Laying a mop on the floor also requires extra time and exertion from the user in the form of deep bending to retrieve the prone mop.

Mop handles leaning against a stationary object such as a wall, also have a tendency to slip and fall onto the floor and/or come into contact with breakable objects. In cases where a surface to lean the mop against is not in close proximity, users must leave the cleaning/treatment site to find a place for the mop to lean against resulting in a loss of time and added user exertion.

Accordingly, the self-standing functionality of embodiments of the device reduces the likelihood of the device handle getting wet or dirty or breaking nearby objects. Embodiments also eliminate the need to bend to pick the device up from the floor thereby lowering exertion rates and reducing the risk of back injury. Embodiments also eliminate the need to walk away from a cleaning location to find a location to lean the mop, and facilitate storage and retrieval from utility closets and the like.

In certain embodiments, the handle may not need to be at an exact 90-degree angle to remain perpendicular/upright, but may be secured at an angle that is within a range of perpendicular, e.g., "substantially perpendicular." As used herein, the term "substantially perpendicular" refers to an angle of 90 degrees, + or – about 10 degrees, between handle and head portion, base of the head portion, or treatment surface. The ability of the handle to remain at a substantially perpendicular angle is a function of the materials, size and weight of the base 60 of the head portion and of the handle 20, and whether the components are wet or dry. In certain embodiments, it is possible that the handle can be secured at angles up to about 20 degrees from perpendicular.

Referring back to FIG. 2, the head portion 30 of the device 10 includes a base 60 that features a plurality of cut outs or slots 70 that are configured to receive a sheet of surface preparation material 100. As used herein, the term "sheet" refers to a surface material having a generally sheet like conformation and includes, but is not limited to, rags, cloths, textiles, cellulosic materials, and the like. In the depicted embodiment, the base 60 includes four slots 70, one on each face or side of the quadrilateral base 60. Each of the slots 70, in turn, includes an aperture 72 that is configured to accept a user's thumb or finger during installation of the surface preparation material. Each slot 70 also includes two end openings 74 that allow sheet material extend into and gather during use as well as two wings 76 that removably secure, e.g., pinch, the surface preparation material within the slot 70.

While the depicted embodiment shows a quadrilateral shaped base 60, the invention is not limited to such shapes. As will be appreciated, the geometry of the base 60 may vary, and other shapes, e.g., circular, triangular, etc. may be employed. Likewise, the number and position of slots 70 may vary depending on various factors including the shape and size of the base, the intended use, and the like. In certain embodiments, the shape of the slots themselves may vary, though it is important that a user be able to quickly and conveniently secure a sheet of material 100 to the base 60 in a manner that does not require undue dexterity, and that the sheet of material remain fixed while in use.

Moreover, the base 60 may be manufactured from materials that vary in thickness/flexibility. For certain applications, it may be desirable to have a flexible base 60 capable of cleaning concave surfaces such as the inside of a bathtub. In other applications it may be desirable to have a rigid base 60 that is resistant to deformation.

FIGS. 4A-4D depict a method of removably securing a sheet of surface preparation material 100 to the base 60 in accordance with an embodiment of the invention. As shown, at a first step (FIG. 4A) a user places the base 60 on a sheet of surface preparation material 100. The base 60 may be placed such that the base side surfaces 62 are offset from the sides of the rectangular sheet 100. This orientation forms triangular sheet portions 110, which may then be folded over toward the ball 50. The tip of each triangular sheet portion 110 is then pressed into each slot 70 via the aperture 72. As depicted, a user may press the sheet portion 110 into the aperture 72 using a thumb. Once the sheet portion 110 is pressed into the slot 70 it is secured in place, at least in part, by the wings 76. Removal is accomplished by simply pulling each portion 110 out of each slot 70. While the installation of the material 100 is depicted on a head 30 and base 60 that does not include a handle, it may be possible to complete installation without removing the handle 20 from the head 30.

Figure 5B:
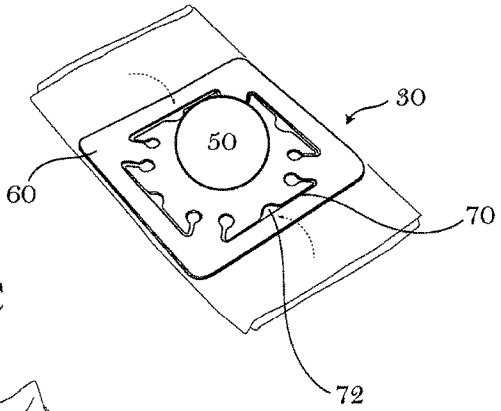
FIGS. 5A-5C are schematic illustrations depicting an alternative method of securing a sheet of surface preparation material to a surface preparation device in accordance with embodiments of the invention.
Figure 5C:
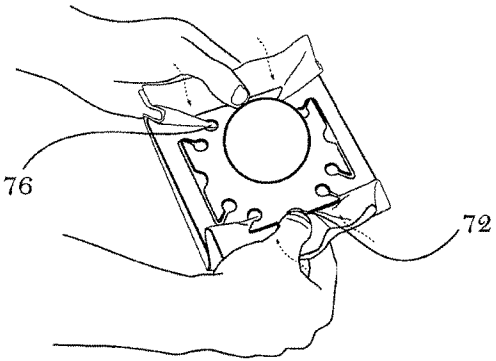
Figure 5A:
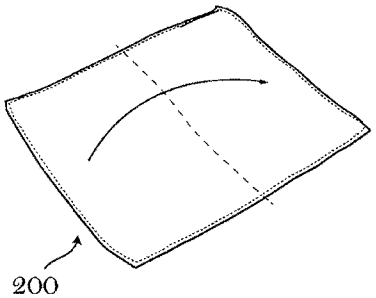

Referring now to FIGS. 5A-5C, an alternative method of removably securing a sheet of surface preparation material 200 to the base 60 is depicted. This method involves folding a sheet of surface preparation material 200 in half so that one half overlaps the other forming a rectangle. The base 60 is then placed on top of the folded sheet 200 and the sheet ends 202 that extend beyond the head 30 are pressed into each slot 70 via apertures 72. This particular installation method may be particularly suited for smaller sheets of material, e.g., 12 inch sheets, while the method of FIGS. 4A-4D may be well suited for larger sheets, such as 16 inch sheets. That said, these methods are not limited to any particular size, configuration or type of sheet material.

As will be appreciated, the design of the head 30 and base 60 allow a user to relatively quickly change the sheet material and provide a great deal of flexibility in use of the device 10. For example, the user may change from a dirty cloth to a clean one, or fold the dirty cloth over to expose a clean face for further cleaning. The user may also quickly swap material to complete a different task. In other embodiments, to increase ease of installation and removal, the base 60 may have a surface that includes hook and loop portions, as opposed to, or in addition to the slots 70. The hook and loop fasteners may be located around the perimeter of the base 60 or in other configurations.

Embodiments of the invention provide an apparatus for preparing a surface that includes an elongated handle and a head portion removably securable to the elongated handle via a pivot joint, the head portion being adapted to receive a surface preparation material. The apparatus is configured to allow a user prepare a surface by grasping the elongated handle when it is attached and to prepare a surface by grasping an ergonomic portion of the pivot joint when the elongated handle detached from the head portion. The pivot joint may include a ball, configured to form an ergonomic handgrip when the handle is disconnected from the head portion, and a socket a configured to removably receive the ball. The ball is located on the head portion and the socket is located on a distal end of the handle. The ball and socket are pivotally interconnected via a snap or press fit. The head portion includes a plurality of slots configured to removably secure a sheet of surface preparation material to the head portion at least one of the slots includes an aperture configured to allow a user to urge a portion of the material into the slot. The head portion is flexible such that it may be used to prepare a curved surface and, in embodiments, the handle is adjustable in length. The pivot joint allows the head portion to remain in a selectively fixed position relative to the elongated handle.

In other embodiments, the invention provides a surface preparation apparatus that includes a head portion having a base configured to removably receive a surface preparation material and a spherical handle located on the base, the spherical handle being sized for gripping by a human hand. The spherical handle is configured to pivotally and selectively mate with an elongated handle such that a user may prepare a surface by gripping the spherical handle, or, if attached, the elongated handle. The elongated handle includes a socket configured to mate with the spherical handle. The socket is located on a distal end of the elongated handle and the spherical handle and socket are pivotally interconnected via a snap or press fit. The base includes plurality of slots that are configured to removably secure a sheet of surface preparation material to the head portion and at least one of the slots includes an aperture configured to allow a user to urge a portion of the sheet into the slot. The head portion is flexible such that it may be used to prepare a curved surface.

In yet other embodiments, the invention provides a method of securing a surface preparation material to a preparation apparatus by placing a head portion of the apparatus on a first side of a sheet of surface preparation material, folding the surface preparation material over onto the head portion and inserting folded over portions of the surface preparation material into a plurality of slots formed in the head portion to removably secure the material to the preparation apparatus. The head portion includes a spherical handle and the method includes gripping the spherical handle to prepare a surface. The method may further include securing an elongated handle to the spherical handle such that the head portion may pivot about the elongated handle and gripping the elongated handle to prepare a surface.

In other embodiments, the invention provides a method of surface preparation that includes removably securing an elongated handle to a spherical handle having a surface preparation material, preparing a first surface with the surface preparation material, and removing the elongated handle from the spherical handle. The method further includes gripping the spherical handle directly by hand and manipulating the spherical handle to prepare a second surface.

In other embodiments, an apparatus for preparing a surface includes an elongated handle and a head portion removably securable to the elongated handle via a pivot joint, the head portion being adapted to receive a surface preparation material and being capable of pivotal movement relative to the elongated handle. The apparatus is configured to allow the elongated handle to remain substantially perpendicular to the head portion without any external support. The apparatus is configured to allow a user prepare a surface by grasping the elongated handle when it is attached and to prepare a surface by grasping an ergonomic portion of the pivot joint when the elongated handle detached from the head portion. The pivot joint may include a ball, configured to form an ergonomic handgrip when the handle is disconnected from the head portion, and a socket a configured to removably receive the ball. The ball is located on the head portion and the socket is located on a distal end of the handle. The ball and socket are pivotally interconnected via a snap or press fit. The head portion includes a plurality of slots configured to removably secure a sheet of surface preparation material to the head portion at least one of the slots includes an aperture configured to allow a user to urge a portion of the material into the slot. The head portion is flexible such that it may be used to prepare a curved surface and, in embodiments, the handle is adjustable in length. The pivot joint allows the head portion to remain in a selectively fixed position relative to the elongated handle.

In yet other embodiments, the invention provides a surface preparation apparatus that includes a head portion having a base configured to removably receive a surface preparation material and a spherical handle located on the base, the spherical handle being sized for gripping by a human hand. The spherical handle is configured to pivotally and selectively mate with an elongated handle such that a user may prepare a surface by gripping the spherical handle, or, if attached, the elongated handle. The apparatus being configured to allow the spherical handle to remain substantially perpendicular to the base without any external support. The elongated handle includes a socket configured to mate with the spherical handle. The socket is located on a distal end of the elongated handle and the spherical handle and socket are pivotally interconnected via a snap or press fit. The base includes plurality of slots that are configured to removably secure a sheet of surface preparation material to the head portion and at least one of the slots includes an aperture configured to allow a user to urge a portion of the sheet into the slot. The head portion is flexible such that it may be used to prepare a curved surface.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

This written description uses examples to disclose several embodiments of the invention, including the best mode, and also to enable one of ordinary skill in the art to practice embodiments of the invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal language of the claims.

As used herein, an element or step recited in the singular and proceeded with the word "a" or "an" should be understood as not excluding plural of the elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described apparatus and method, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A surface preparation apparatus comprising:

a head portion having a base configured to removably receive a surface preparation material; and a spherical handle located on and fixed to the base, the spherical handle being sized for ergonomic gripping by a human hand;

wherein the spherical handle is dimensioned and configured to pivotally and selectively mate with a socket on a distal end of an elongated handle via a frictional fit such that a user may prepare a surface by gripping the spherical handle, or, if attached, the elongated handle; and wherein the frictional fit of the spherical handle and socket allows the elongated handle to be rotated about the spherical handle during use and to be resiliently maintained in a fixed position relative to the head portion when not in use.

2. The apparatus of claim 1 wherein the spherical handle and socket are pivotally interconnected via a snap or press fit.

3. The apparatus of claim 1 wherein the base includes plurality of slots that are configured to removably secure a sheet of surface preparation material to the head portion.

4. The apparatus of claim 3 wherein at least one of the slots includes an aperture configured to allow a user to urge a portion of the sheet into the slot.

5. The apparatus of claim 1 wherein the head portion is flexible such that it may be used to prepare a curved surface.

6. The apparatus of claim 1, wherein:

the ball has a diameter between about 2 inches and about 4 inches.

7. An apparatus for preparing a surface comprising:

an elongated handle having a socket located on a distal end of the elongated handle;

a head portion having a ball fixed to the head portion, the head portion being adapted to receive a surface preparation material, the ball having a diameter of between about 2 inches and about 4 inches;

wherein the socket is configured to removably receive the ball to removably secure the head portion to the elongated handle; and wherein the ball and the socket are held together by a frictional fit which allows the elongated handle to be freely rotated with respect to the head portion during use, and the elongated handle to remain substantially perpendicular to the head portion without any external support when not in use; and wherein the apparatus allows a user to prepare a surface by grasping the elongated handle when it is attached to the head portion, and to prepare a surface by grasping the ball on the head portion with a power grip when the elongated handle is detached from the head portion.

8. An apparatus for preparing a surface comprising:

an elongated handle having a socket located on a distal end of the elongated handle;

a head portion having a ball fixed to the head portion the head portion being adapted to receive a surface preparation material;

wherein the socket is configured to removably receive the ball to removably secure the head portion to the elongated handle; and wherein the ball is configured to form an ergonomic handgrip when the elongated handle is disconnected from the head portion, and is sized to allow a user to grasp the ball with a power grip to prepare a surface with the head portion, and wherein:

the ball and the socket are held together by a frictional fit which allows the elongated handle to be rotated with respect to the head portion during use, and the elongated handle to remain substantially perpendicular to the head portion without any external support when not in use.

9. The apparatus of claim 8 wherein the ball and socket are pivotally interconnected via a snap or press fit.

10. The apparatus of claim 8 wherein the head portion includes a plurality of slots configured to removably secure a surface preparation material to the head portion.

11. The apparatus of claim 8 wherein at least one of the slots includes an aperture configured to allow a user to urge a portion of the material into the slot.

12. The apparatus of claim 8 wherein the head portion is flexible such that it may be used to prepare a curved surface.

13. The apparatus of claim 8 wherein the handle is adjustable in length.

* * * * *